US005430229A

United States Patent [19]

Voss

[11] Patent Number: 5,430,229

[45] Date of Patent: Jul. 4, 1995

[54] CHEMICAL PROCESS FOR DISPOSAL OF ROCKET PROPELLANT CONTAINING NITRATE ESTER

[75] Inventor: Kim R. Voss, Longwood, Fla.

[73] Assignee: Hercules Incorporated, Wilmington, Del.

[21] Appl. No.: 998,509

[22] Filed: Dec. 30, 1992

[51] Int. Cl.[6] ..... C06B 25/00

[52] U.S. Cl. ..... 588/202; 588/203; 149/107

[58] Field of Search ..... 588/202, 203; 149/107

[56] References Cited

U.S. PATENT DOCUMENTS

| | | | |
|---|---|---|---|
| Re. 34,419 | 10/1993 | Melvin et al. | 149/109.6 |
| 4,198,209 | 4/1980 | Frosch et al. | 588/202 X |
| 4,854,982 | 8/1989 | Melvin et al. | 149/109.6 |
| 4,909,868 | 3/1990 | Melvin | 149/109.6 |
| 5,250,161 | 10/1993 | Chin et al. | 588/202 X |
| 5,284,995 | 2/1994 | Melvin | 588/203 |

OTHER PUBLICATIONS

Davis et al., Technical Report CR-RD-PR-90-5, *Critical Fluid Demilitarization of Rocket Motors by Liquid Ammonia Extraction,* Stone Eng'g Co., Jun., 1990.

*Primary Examiner*—Peter A. Nelson
*Attorney, Agent, or Firm*—Mark Goldberg

[57] ABSTRACT

Gel and solid rocket propellant is physically and chemically ablated from motors using a liquid or gaseous reagent such as anhydrous ammonia propelled by compressed nitrogen gas at 2000 psig or higher. Nitroglycerine and nitrocellulose are nitrate esters preferentially ablated from class 1.1 rocket propellant by anhydrous ammonia at a temperature of 70° F. or higher.

12 Claims, 1 Drawing Sheet

CHEMICAL PROCESS FOR DISPOSAL OF ROCKET PROPELLANT CONTAINING NITRATE ESTER

FIELD OF THE INVENTION

The invention relates to the disposal of propellants without resorting to burning or exploding.

BACKGROUND OF THE INVENTION

There exists a need for safe disposal of pyrotechnic, explosive and propellant materials without open burning or open detonation (OB/OD) and without accidental detonation during the disposal process. The volume of such materials that require disposal has greatly increased due to the reduction in inventories of weapons following the end of the Cold War. Existing processes for disposal do not fully meet the needs for Class 1.1, 1.2 and some 1.3 rocket propellants.

Class 1.1 rocket propellants create the greatest problem for disposal by other than open detonation since the nitroglycerine and nitrocellulose in the Class 1.1 propellant matrix make the composition detonatable. Class 1.2 rocket propellants, while still being detonatable, do not contain nitroglycerine and are less shock sensitive than those of Class 1.1. Class 1.3 propellants contain ammonium perchlorate (AP) rather than nitroglycerine and nitrocellulose with the rocket propellants representing primarily a fire hazard during disposal rather than an explosion hazard.

Prior to the present invention, water jets have been employed to remove propellant from a loaded rocket motor. This method has been quite effective with Class 1.3 propellants. It is also effective with 1.1 propellants but the remaining "crumb" is still detonable. In addition, a problem with the use of water jets still exists because this method produces contaminated water, thereby adding to the disposal problem.

U.S. Pat. No. 4,854,982 discloses the physical process of extracting and recovering ammonium perchlorate (AP) from a solid composite propellant composition using liquid ammonia in a pressurized recycle system. This system was run under ambient temperatures wherein ammonia was liquified under its own vapor pressure at about 114 psig. AP was recovered by precipitation in a uniform size and configuration for recycling or other uses by vaporization of liquid ammonia containing dissolved AP. By selectively dissolving out AP from the propellant the solid matrix became porous such that the other components of the composition were mechanically removed.

A problem exists with some rocket propellants which contain some AP even after the AP is dissolved out by the liquid ammonia. The porous structure which remains must still be broken up by physical means. This can be a dangerous undertaking in situations where the AP has been removed but nitroglycerine or nitrocellulose are still a part of the porous structure.

High pressure sprays of oil have been used in a manner similar to water jets to physically break up the structure of Class 1.3 propellants. This method has not been useful for crosslinked propellants, where it has been necessary to cut into the metal casing of a rocket motor in order to physically remove the propellant. The physical shock of cutting into a rocket motor casing containing Class 1.1 or 1.2 propellant may detonate or ignite the composition.

Thus prior to the present invention, a need existed for a safe and cost efficient method of disposal for Class 1.1, 1.2 and some 1.3 propellants which contained shock sensitive nitrate esters (nitroglycerine and nitrocellulose) and other detonatable ingredients.

SUMMARY OF THE INVENTION

The process of the invention uses a pressurized liquid stream of an anhydrous reagent capable of degrading a nitrate ester to break up a propellant matrix by chemical ablation of a propellant containing a nitrate ester such as nitroglycerine, nitroglycol or nitrocellulose. Suitable anhydrous reagents are $NH_3$, $CO_2$ and $N_2O$.

In the preferred process of the present invention is provided a process for Class 1.1 propellant disposal comprising applying ammonia to a crosslinked propellant matrix that is inside a container such as a rocket or missile casing and physically removing chemically ablated propellant from the container. These Class 1.1 propellants generally contain two or more of the following compounds: nitroglycerine, nitrocellulose, resorcinol and 2-nitrodiphenylamine.

DETAILED DESCRIPTION OF THE INVENTION

Figure 1:
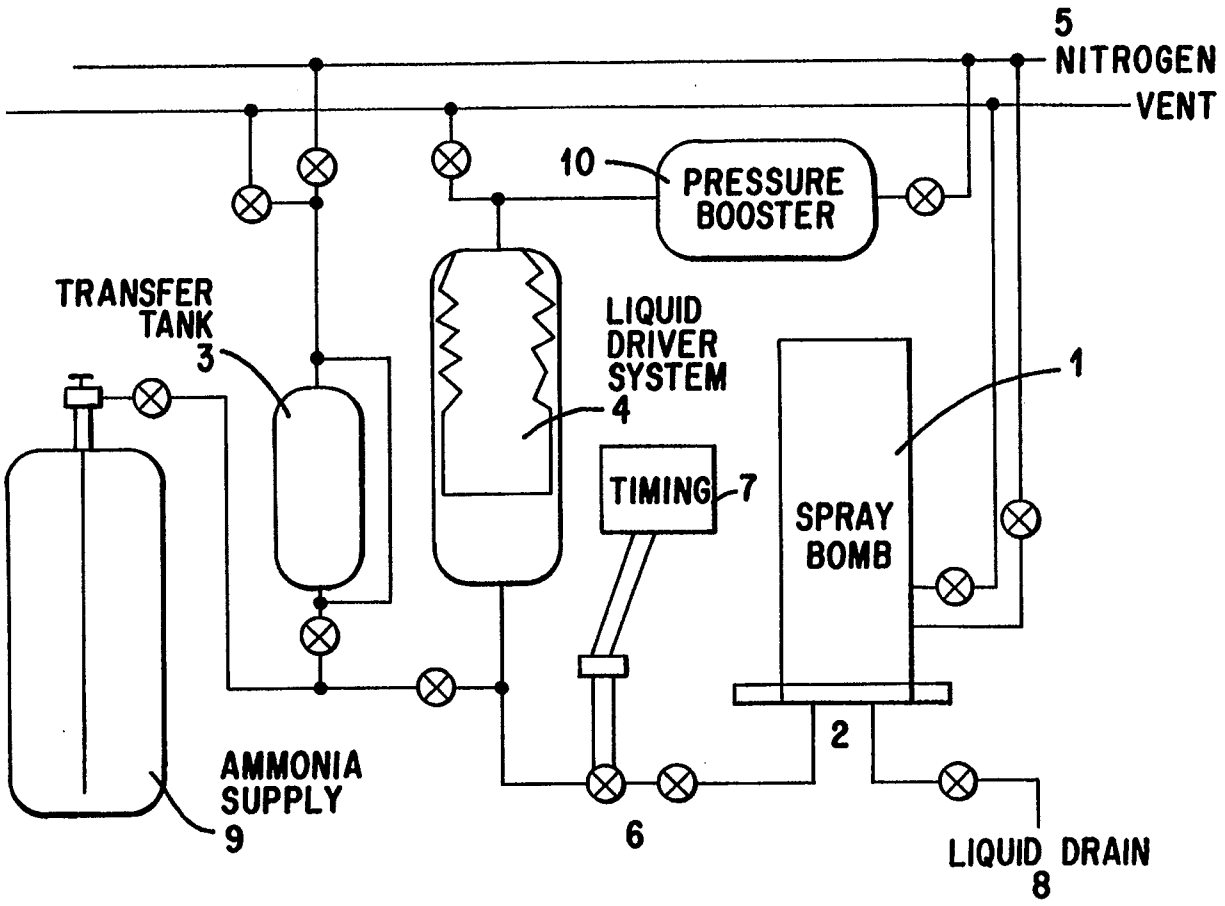
FIG. 1—A liquid-jet spray apparatus used for ablation tests is illustrated.

The present invention involves the disposal of certain of the types of ammunition, propellants and explosives that are classified in the U.S. Department of Defense's DOD4145.26-M DOD Contractors Manual for Ammunition and Explosives (March 1986) according to the hazard they represent. These are:

Class 1.1 Mass Detonation Hazard

Class 1.2 Non Mass Detonation Hazard—Fragment Producing

Class 1.3 Mass Fire Hazard

Class 1.4 Moderate Fire Hazard—No Blast

As used in the chemical process of the present invention several forms of the word "ablate" are used which require definition in the context of the invention: the verb—ablate, the gerund—ablating, the participle—ablated, and the noun—ablation.

Within the context of breaking up an explosive matrix "ablate" means to chemically react and to permanently alter the molecular weight and structure within a chemically crosslinked and/or nitrate ester containing explosive matrix.

As applied to the process of spraying an anhydrous reagent onto the surface of an explosive matrix "ablating" means the chemical reaction of the anhydrous reagent within the explosive matrix to chemically and irreversibly change the molecular weight and structure to allow unreacted material to be physically removed via the physical force of the spray.

In an explosive matrix containing resorcinol and nitrate esters "ablated" means that the explosive matrix is chemically reacted to the extent that effective and/or significant levels of the original form and concentration of resorcinol and nitrate esters no longer exist within the explosive matrix and structural integrity of the explosive matrix is destroyed.

In the present invention, "ablation" means an explosive matrix broken apart by irreversible chemical change primarily to nitrocellulose and nitroglycerine rather than a purely physical dissolution and precipitation of propellant ingredients as in the use of the ammonia spray in the prior art with ammonium perchlorate-containing propellants.

It is believed that the chemical reactions involving the anhydrous reagent and nitrate esters involve both molecular weight reduction and ester cleavage.

Delivered as a high pressure jet to a propellant surface, ammonia both physically breaks down the structure and chemically reacts with nitrate esters and other propellant components. In its physical and chemical effect on the propellant the ammonia is acting like a "liquid knife." Chemical degradation acts in concert with the force of the jet as the "liquid knife" cuts into the propellant structure.

Because of the heterogeneous nature of the propellants tested (Class 1.1 & 1.3), prior to the present invention it was not believed possible to have partial or selective physical solubilization of one or more components of the propellant into a particular solvent. It was further assumed that the physical force with which an anhydrous liquid struck the propellant would determine how quickly the propellant matrix could be ablated. These beliefs and assumptions were found to be incorrect in the reduction to practice of the present invention.

In the process of liquid jet cutting, the kinetic energy carried in the moving fluid generates a stress in the target sample sufficient to cause material failure. Any liquid could, in principle, be used to deliver the energy to break apart the solid but different liquids will not be equally effective. The reasons for a difference can be separated, for purposes of discussion into those affecting the power of the liquid jet and those having to do with the specific chemical nature of the materials.

Power expresses the rate at which energy is delivered, in this case, the kinetic energy of the liquid jet incident on the solid propellant sample. This rate is dependent on the mass flow rate of the liquid. It was a constant in the experiments that led to the present invention that the cross section of the liquid jet was constant for all runs so therefore in order to compare ammonia and water it is necessary to compare the respective mass flow rates. It was determined that the primary difference in flow between ammonia and water would be due to their different mass. Liquid ammonia is less dense than water at room temperature. Using values of 0.7 g/ml and 1.0 g/ml for ammonia and water respectively, ammonia will have a velocity 1.2 times greater than water for the same driver pressure differential. Volumetric flows are in the same ratio. For experiments run with a 2000 psig driver pressure, the linear velocity of the ammonia jet was close to 200 m/s with a volumetric flow rate of 300 ml/s. When mass flows are compared the velocity ratio is multiplied by the density ratio of 0.7 giving 0.84. Thus for conditions where ammonia and water behave similarly in all ways except for the usual density difference, the ammonia jet carries 84 percent of the power in the corresponding water jet. The experiments herein were run near the threshold power for ablation so they were designed to measure the actual differences between ammonia and water.

The results shown in ablation-time comparisons clearly demonstrate that with CMDB propellants, the ammonia jet causes greater ablation than water except during short exposure times. From the results it is clear that ammonia must have some properties that more than offset ammonia's reduced power inherent in its lower density. The enhanced ablative action and the ablation delay are explained by examining the chemical effects of ammonia. In contrast, with the CMDB propellants, the XLDB and HTPB type propellants which contain crosslinked binders were ablated to a lesser degree with ammonia as compared with water. Determining the ratio of the effect of ammonia compared with water is complicated by the delay in onset of ablation for ammonia. With XLDB, ammonia had about 0.6 the effect of water as opposed to 0.84 ratio predicted based solely upon the differences in density of the two fluids. With the HTPB composite propellant, the ratio is on the order of 0.4–0.5, which is also less than predicted. However, much of the ammonia onset delay may be attributed to the way the tests were run in that it took a short time after the valve was opened for a liquid stream of ammonia to develop. If this is a valid explanation, then the differences between water and ammonia for the propellants containing crosslinked polymers would not be as great.

It is believed that much of the difference in the ablation of the propellants between water and ammonia is attributable to the chemical reactivity with the propellant. Water is essentially inert toward all of the propellants at room temperature and for the short times involved. In contrast, ammonia is quite reactive with the Class 1.1 propellants that contain certain nitrate esters. All of the 1.1 propellants tested with the present invention, contain nitroglycerine, which decomposes very rapidly in liquid ammonia. However, this incompatibility is not believed to be a significant factor in the way that ammonia ablates propellant in the short duration tests. On a time scale of 10 seconds or less, the reaction will be localized to the surface where ammonia is available for reaction. For longer duration exposure, on the order of minutes to hours, ammonia can diffuse into the bulk phase where it reacts and dramatically alters the mechanical properties of the propellant.

The results with XLDB samples are interpreted as indicating that ammonia reactivity with nitroglycerine in a cross-linked binder propellant was not a factor in the results obtained. The surface of XLDB samples following removal from the test bomb after exposure to the ammonia jet appeared the same as unexposed propellant. Even the surfaces of the hole made by the ammonia jet action had the original color and appearance. Other tests have shown that under conditions where the nitroglycerine in this type of propellant does react with ammonia there is a noticeable darkening and blistering of the surface. In the photographs taken of the ablated XLDB samples some blisters were evident but were believed to result from post test reaction with the residual ammonia left on the sample cube.

The CMDB propellants that were subjected to the ammonia jet contain significant amounts of nitrocellulose as well as nitroglycerine. The liquid nitroglycerine is absorbed into the polymeric nitrocellulose forming a rigid gel. Similar to nitroglycerine, the nitrate ester groups on nitrocellulose are quite reactive to ammonia vapor.

Another factor in the activity between the liquid and propellant that could affect ablation is solubility effects. Solid propellants, while having reproducible properties of mechanical strength and burn rate, are not microscopically homogeneous. The polymeric matrix is filled with solid particles of oxidizers and fuels, and also has liquid plasticizers dissolved into the network. Because of this heterogeneous nature, it is possible that there is partial or selective solubilization of one or more components of the propellant into a particular solvent. In general, none of the binders themselves are soluble in a classical sense, in either water or ammonia. The isocyanate cross-linked binders were found to be the most difficult to ablate. The 2 to 5 second delay before visible effects of the "liquid knife" were observed is a result of the requirement for the ammonia to first penetrate the structure and begin ablating the propellant ingredients such as esters and plasticizers. Large increases in surface area and porosity which contribute to ablation begin after the first few seconds. In the propellants where ammonia was effective in causing chemical ablation once ammonia can easily penetrate the porous structure, the disintegration process is considerably faster than is the case for a water jet spray.

The following procedures and examples illustrate the practice of the invention without being limiting.

DETAILED DESCRIPTION OF THE DRAWING

FIG. 1—The liquid-jet spray apparatus illustrated used high pressure nitrogen to drive the liquid jet. The spray bomb 1 was a high pressure combustion bomb normally used for propellant combustion studies. The liquid-jet 2 was driven under pressures of 1700, 2000 and 2300 psig boosted with a small compressor 10 against a lower pressure in the spray bomb 1. A known volume of liquid was first placed in the transfer tank 3 and then moved into the driver bottle 4 using the nitrogen gas 5. The valve 6 was kept open for a prescribed time period which could be set by timing 7. In addition to liquid drain valve 8 the system required ammonia supply 9 and pressure booster 10 and other valves and vents.

REAGENT & SAFETY PRECAUTIONS

The ammonia was anhydrous grade (99.99% in the liquid) purchased from Air Products and Chemicals, Inc. It was used as received from the cylinder after being passed through a 0.5 micron stainless steel frit filter to remove rust and particles that could plug the spray orifice. All lines and vessels used to handle ammonia were either steel or stainless steel. The driver system bladder was made of butyl rubber. It was important to dry the bladder very well when changing from water to ammonia since the hydration of ammonia is quite exothermic and can cause thermal deterioration of the rubber. When using liquid ammonia the loaded and sealed bomb was pumped off by a vacuum pump to remove air and back filled to one atmosphere with nitrogen. This procedure eliminated the possibility that an ignited propellant sample could initiate an air-ammonia gas mixture explosion. The bomb was thoroughly purged with nitrogen to remove ammonia vapors before opening the bomb after a test. A video camera recorded the action of the jet on a cube of propellant through a window on the bomb. Sample cubes, 1.5 inch on edge, were cut in a manual guillotine and inspected for uniformity and absence of cracks before use. The test bomb was evacuated before each test run. No test cube was ever reused.

With a boiling point of −33° C., ammonia is much more volatile than water (normal boiling point 100° C.) at the 20°–25° C. temperature used in the tests. In terms of handling it was apparent that ammonia must be kept in a closed system capable of maintaining an above-atmospheric vapor pressure. This pressure is 786 kPa (114 psig) at 21° C. (70° F.). Letting a system drop to a partial pressure below this value would cause boiling and vaporization in the liquid ammonia phase.

It was determined during the experiments described below that anhydrous ammonia chemically reacts with nitrate ester (nitro ester) containing propellants causing a noticeable change in physical properties. Comparative chemical analysis before and after exposure of propellant samples to ammonia spray revealed surprising chemical changes in nitrate ester as well as in other ingredients.

When the ammonia spray was started, the liquid emerged into a chamber at zero partial pressure of ammonia. Under this condition it was expected that the liquid stream will be boiling and flashing off, thereby reducing the effective power of the jet relative to one developed at equilibrium conditions.

The following Table 1 lists the type of propellant samples used in the following examples with their Shore A hardness values.

TABLE 1

| Identification | Composition | Shore A Hardness |
|---|---|---|
| CMDB-1 | Composite Modified Double Base formulation; A gel formed from absorption of nitroglycerin (NG) and triacetin in nitrocellulose (NC); filled with HMX, ammonium perchlorate and aluminum solids, also contains stabilizers. | 66 |
| CMDB-2 | Same type as CMDB-1 with higher AP level and lower HMX. Physically a harder propellant than CMDB-1. | 75 |
| XLDB | Cross-linked Double Base formulation; an isocyanate cured polyester binder (polydiethylene-glycol adipate) filled with HMX, AP, aluminum, NC solids and liquid NG, contains low levels of stabilizers, cure catalysts and bonding agents. | 44 |
| NEPE | Nitrate Ester-PolyEther; an isocyanate cured polyethylene glycol binder with same major ingredients as XLDB. | 44 |
| HTPB | Hydroxy Terminated PolyButadiene; an isocyanate cured polymeric binder filled with AP and aluminum solids, minor amounts of antioxidants, cure catalyst and bonding agent. | 50 |

EXAMPLE 1

The apparatus shown in FIG. 1 was used for a series of jet impingement time tests both with water and liquid ammonia. No precautions were taken to insure that ammonia would remain in the liquid state once sprayed from the jet nozzle toward the test cube at a 2000 psi pressure and a fixed standoff distance of 3.5 inches. In this experiment small blocks of propellant were exposed to a small diameter, high velocity stream of water or ammonia. Table 2 summarizes the jet impingement times in relation to different propellants. In all tests run during initial characterization of the process the times are set forth in seconds or fractions of a second.

TABLE 2

| Stream | CMDB-1 | CMDB-2 | XLDB | NEPE | HTPB |
|---|---|---|---|---|---|
| $H_2O$ | 0.7, 1.2, 2.8, 4.5, 8.4 | 2.6, 4.5, 6.2, 8.2 | 0.5, 0.7, 0.8, 1.1 | 0.7, 1.1, 2.7, 4.5, 8.4 | 0.7, 1.1, 2.7, 3.7, 4.3 |
| $NH_3$ | 2.6, 5.2, 8.2 | 3.9, 5.4, 8.2 | 2.0, 3.9, 5.4 | — | 2.4, 3.2, 3.5, 4.4 |

The data collected from the jet spray tests summarized in Table 2 was used to prepare graphs plotting percentage ablation (physical or chemical) of a test block of propellant versus time of jet spray impingement on the test block. Graphs 1 and 2 below illustrate the difference in effect for crosslinked propellant (Graph 1) in comparison to uncrosslinked propellant (Graph 2). Water is represented by a solid line and ammonia by a dotted line.

Graph 1

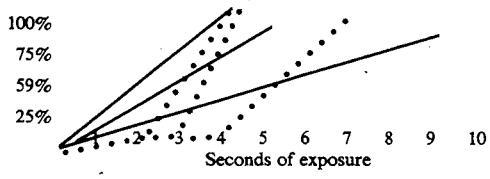

Graph 2

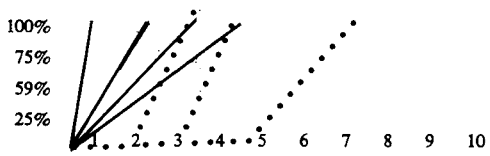

As illustrated by the representative curves, there appears to be an initial induction period before any physical effect can be observed with both crosslinked and uncrosslinked propellant. Surprisingly it was observed that this induction time was only slightly longer for crosslinked propellant than for uncrosslinked propellant. It was therefore concluded that some type of chemical change was taking place within the propellant matrix prior to observing any breakup of structure. The curves for water jet spray are typical of a breakup proportional to physical force applied to the propellant matrix.

From this test it was determined that the range of times required for ablation of different propellants varied from 0.5 to 9 seconds. It was observed that water caused an instantaneous physical ablation on any of the test cubes, whereas a stream of ammonia was showing no effect whatsoever during the same short times during which water completely ablated some of the cubes.

While it took longer for the ammonia to begin to break up (ablate) the propellant structure, once the ammonia reacted with the nitrate esters within the propellant matrix the process of breakup (ablation) was more rapid than was the case for water jet spray.

EXAMPLE 2

A second series of tests was run in the same apparatus with a constant 5 second spray time at pressures of 1700, 2000 and 2300 psig. Standoff distances of both 3.5 and 1.75 in. were used to obtain a rough estimate of how sensitive the extent of ablation was to standoff distance. In all cases the water or liquid ammonia jet from the spray base was directed at the center face of the test cube. After the test the cubes were cross-sectioned and depth of penetration was measured.

From an examination of the size and shape of the ablated hole or pit in the cube it was confirmed that chemical rather than physical force parameters were important in effectively ablating the propellant. It was further possible to determine by viewing video recordings that either ammonia liquid or vapor could chemically ablate both solid and gel propellants.

EXAMPLE 3

Chemical Analysis of Propellants Chemically Ablated with Ammonia

Class 1.1 propellants were treated with ammonia under a variety of conditions. As shown in Table 3, diminished levels of nitrate ester and stabilizer were obtained using those chemical ablation methods which had not previously been observed with either water jet sprays or dissolution with liquid ammonia. Two different CMDB propellants were treated with liquid ammonia. Percentages shown represent amounts remaining after liquid and/or gas exposure. (2-NDPA=2-nitrodiphenylamine). Thus, for example, a test sample which originally contained 100 g of a nitrate ester such as nitrocellulose would contain from 0.7 g to 69.2 g nitrocellulose after the indicated exposure.

TABLE 3

Chemical Analysis of Ammonia Degraded CMDB Propellants Shows Diminished Nitrate Ester and Stabilizer Levels

| | | | Percent Remaining of Listed Ingredient After Ammonia Contact | | |
|---|---|---|---|---|---|
| TYPE | INITIAL PRES. (PSIA) | LIQUEFY ? | % NITRATE ESTER | % RESORCINOL | % 2-NDPA |
| 1 | 3 | NO | 69.2 | 8.0 | 74.6 |
| 1 | 65 | YES | 0.07 | 0 | 23.5 |
| 1 | 118 | YES | 2.67 | 0 | 12.3 |
| | 2 FRACTIONS | NO | 24.5 | 0 | 38.4 |
| 2 | 3 | NO | 69.7 | 12.8 | 71.5 |
| 2 | 33 | YES | 1.5 | 0 | 4.7 |
| 2 | 113 | YES | 0.2 | 0 | 27.3 |
| 2 | 103 | PARTIAL | 58.5 | 1.1 | 48.4 |

As shown in Table 3 exposure to only ammonia gas has a significant effect on lowering nitrate esters, nitroamines and a very significant effect in lowering the amount of resorcinol. The liquid/gas exposure degrades the nitrogen compounds to about 50% whereas only a trace of resorcinol remains. With a jet of only liquid ammonia striking the propellant all resorcinol is degraded along with the majority of the nitrogen compounds.

What is claimed is:

1. A process for disposal of propellant which comprises applying an anhydrous reagent to a nitrate ester-containing propellant matrix for a sufficient period of time for the reagent to react with the nitrate ester wherein said reaction results in the chemical ablation of the propellant matrix.

2. The process of claim 1 where the anhydrous reagent is selected from the group consisting of ammonia, carbon dioxide and nitric oxide.

3. The process of claim 1 wherein said anhydrous reagent is ammonia.

4. The process of claim 1 wherein said nitrate ester-containing propellant matrix comprises at least two compounds selected from the group consisting of nitroglycerine, nitrocellulose, and 2-nitrodiphenylamine.

5. The process of claim 4 where the propellant matrix further comprises resorcinol.

6. A process for Class 1.1 propellant disposal comprising applying a stream of ammonia to a crosslinked propellant matrix inside a container for a sufficient period of time to ablate said crosslinked propellant matrix and then physically removing chemically ablated propellant from the container.

7. The process of claim 6 where said stream of ammonia is a liquid and is applied at a temperature of at least 70° F.

8. The process of claim 6 wherein said propellant comprises at least two ingredients selected from the group consisting of nitroglycerine, nitrocellulose, resorcinol and 2-nitrodiphenylamine wherein said ingredients are chemically reacted with said stream of ammonia.

9. The process of claim 6 where the nitrate ester is selected from the group consisting of nitroglycerine, nitrocellulose and nitroglycol.

10. The process of claim 6 where the propellant matrix is a gel and the stream of ammonia is gaseous.

11. The process of claim 6 where the ammonia is propelled by nitrogen.

12. The process of claim 11 where nitrogen provides a pressure of at least about 2000 psig.

* * * * *